US011077359B1

(12) United States Patent
Wigh

(10) Patent No.: US 11,077,359 B1
(45) Date of Patent: Aug. 3, 2021

(54) APPARATUS, SYSTEM AND METHOD FOR SENSING A STATE OF A CUBIC PUZZLE

(71) Applicant: Bryght Labs, Inc., Overland Park, KS (US)

(72) Inventor: Jeffrey Bowman Wigh, Overland Park, KS (US)

(73) Assignee: Bryght Labs, Inc., Overland Park, KS (US)

( * ) Notice: Subject to any disclaimer, the term of this patent is extended or adjusted under 35 U.S.C. 154(b) by 0 days.

(21) Appl. No.: 16/983,569

(22) Filed: Aug. 3, 2020

Related U.S. Application Data

(60) Provisional application No. 62/883,591, filed on Aug. 6, 2019.

(51) Int. Cl.
*A63F 9/08* (2006.01)
*A63F 9/24* (2006.01)

(52) U.S. Cl.
CPC .... *A63F 9/0842* (2013.01); *A63F 2009/0846* (2013.01); *A63F 2009/2401* (2013.01); *A63F 2009/2442* (2013.01); *A63F 2009/2445* (2013.01); *A63F 2009/2457* (2013.01)

(58) Field of Classification Search
CPC ..... A63F 9/0842; A63F 2009/2445; A63F 2009/2442; A63F 2009/0846; A63F 9/08
See application file for complete search history.

(56) References Cited

U.S. PATENT DOCUMENTS 8,398,470 B2 3/2013 Gilles et al.
2008/0237981 A1 10/2008 Gilles et al.
2018/0161668 A1* 6/2018 Chen ..... A63F 9/0842
2019/0114944 A1* 4/2019 Garrett ..... A63F 9/0842
2019/0184275 A1* 6/2019 Su ..... A63F 9/24
2020/0009451 A1* 1/2020 Dor ..... A63F 9/0842

FOREIGN PATENT DOCUMENTS

WO 2018098351 A1 5/2018
WO 2018138586 A1 8/2018
WO 2019092648 A1 5/2019

* cited by examiner

*Primary Examiner* — James S. McClellan

(74) *Attorney, Agent, or Firm* — Build IP, LLC; Robert V. Donahoe

(57) ABSTRACT

According to another aspect, a method of determining a current state of a cubic puzzle independent of information concerning a prior state of the cubic puzzle using at least one RGB sensor. With the cubic puzzle maintained in a first state, (a) illuminating a first colored surface selected from the plurality of colored surfaces with a single source of light selected from the plurality of sources of light because of an association with the first colored surface and sensing a color of the first colored surface with the RGB sensor when the first colored surface is illuminated. Repeating act (a) by separately illuminating each of the plurality of colored surfaces with a respective single source of light selected from the plurality of sources of light because of an association between the respective single source of light and the respective colored surface that is being illuminated, and act of processing the colors sensed by the RGB sensor at each of the preceding acts to determine a location and orientation of each of the plurality of tiles with the cubic puzzle in the first state.

17 Claims, 10 Drawing Sheets

R= Right Face - Right side of the cube

L= Left Face - Left side of the cube

U= Up Face - Top side of the cube

D= Down Face - Bottom side of the cube

F= Front Face - Front side of the cube

B= Back Face - Back side of the cube

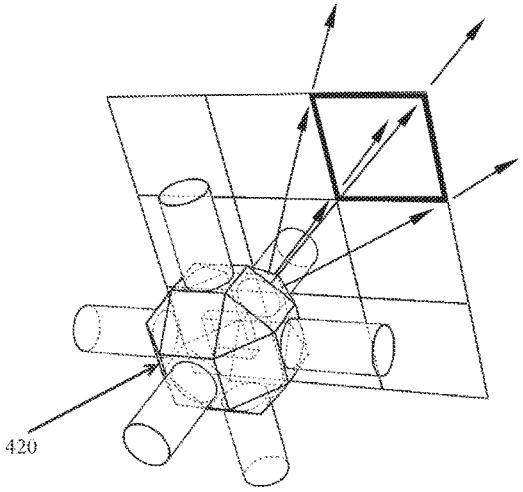
FIG. 4A
FIG. 4B
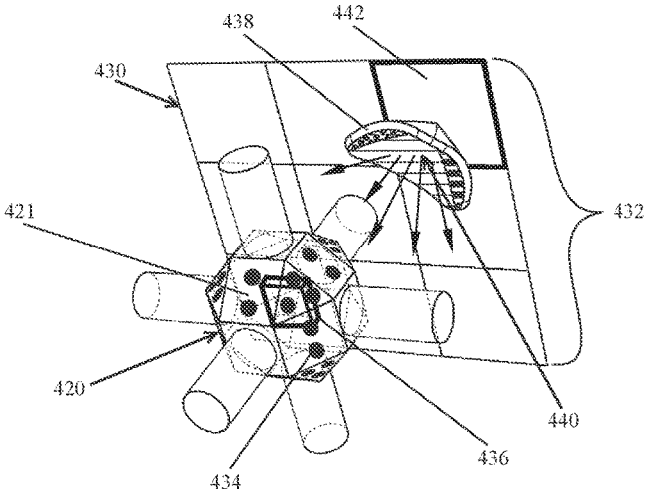

APPARATUS, SYSTEM AND METHOD FOR SENSING A STATE OF A CUBIC PUZZLE

RELATED APPLICATIONS

This application is claims the benefit under 35 U.S.C. § 119(e) to U.S. Provisional Application Ser. No. 62/883,591, entitled "APPARATUS, SYSTEM AND METHOD FOR SENSING A STATE OF A CUBIC PUZZLE AND COMMUNICATING ON-PUZZLE USER INSTRUCTIONS," filed on Aug. 6, 2019, the disclosure of which is herein incorporated by reference in its entirety.

BACKGROUND OF INVENTION

1. Field of Invention

This invention relates generally to apparatus, systems and methods for wirelessly sensing a state of a puzzle. More specifically, at least one embodiment, relates to an electronic apparatus integral to a cubic puzzle that determines the state of the puzzle and communicates on-puzzle user instructions.

2. Discussion of Related Art

The Rubik's Cube is a popular puzzle game with over 350 million units sold. It is one of the best-selling toys of all time. This preceding is despite the fact that most users will never enjoy the satisfaction of solving the puzzle.

As illustrated in FIG. 1A, the Rubik's Cube 100 includes six sides each including nine colored tiles, a total of 54 tiles. The face of each tile is the color of one of the six different colors used in the cube. Nine tiles include a respective one of the six colors. With the exception of the six tiles located at the center of each side, all of the tiles can be rotated about the center of the cube to change the puzzle face in which they are located. The challenge presented by the Rubik's Cube 100 is to solve the puzzle by rotating the pieces around the core to take a scrambled state such as that illustrated in FIG. 1A and place the puzzle in the solved state illustrated in FIG. 1B and a Rubik's Cube 101. In the scrambled state, each puzzle face contains a mixture of various colored tiles. In the solved state, all nine pieces having the same color appear on the same side of the cube.

To a large degree, a user's initial enjoyment and attraction to the puzzle is the mechanical aspect. The seemingly infinite rotational states and the ability for pieces to migrate around the cube independently while the puzzle stays intact can impress the user. However, the solution to a Rubik's Cube is neither intuitive nor easily discovered. Typically, user interest wanes after the initial enjoyment of the mechanics of the puzzle because the puzzle is difficult to solve. Users who do solve the cube are those that take the time to study solving-algorithms. However, this is a small portion of users. The algorithms are not taught through the puzzle itself, i.e., the cube mechanism. Instead, they are available on-line or via another device. FIG. 2 illustrates a set of generic moves that can be combined in various sequences to take one or more steps toward solving the puzzle. Thus, current approaches make the learning process unnecessarily difficult.

While learning and following the algorithm is within the abilities of almost all children and adults, training is unnecessarily difficult because the instructions for the algorithm are not provided on the cube. Instead, the user must: 1) deduce the state of their cube compared to an abstract template online; 2) identify the series of moves to progress the state of the cube; and 3) carry out that sequence of moves while constantly looking between the instructions and their physical cube. The preceding must be completed without losing the exact orientation required while remembering the exact progress of the move sequence.

Further, there are over 43 quintillion states that the puzzle can be in. It is rather difficult for a user to balance all of the deduction, abstraction, instruction, sequencing, and orientation required to learn the solution. If a step gets missed, the user may have to re-start from the beginning. It is not uncommon for a typical algorithm to require 100+ rotation sequences. The result of this approach is that users often get frustrated and give up without ever solving the puzzle.

In an attempt to aid users, some prior approaches have employed a mobile application in combination with sensing systems included in the puzzle to assist users. However, these prior approaches still require that the user refer to a secondary device, for example, a mobile phone, for feedback. In theory, electronics or other sensor hardware can be distributed in individual segments that make up the puzzle. However, in practice, such an approach results in a complicated assembly that has numerous electrical-connection points for the electronic and sensing hardware all within the cubic puzzle. Each of these connection points is a potential point of failure. For example, a cubic puzzle is made of over 20 individual pieces assembled together in a manner that allows them to change their location relative to one another. As a result, it is costly and complex to provide power and communication to the individual pieces. Further, the required circuitry and electrical connections between the moveable puzzle pieces reduces the reliability of the electronics.

Electronic-based approaches for puzzle-solving face the challenge of trying to determine a current state of the puzzle, that is, the location and orientation of each of the various pieces. The preceding is particularly problematic when the state of the puzzle must be determined from an unknown state. This circumstance can occur when the puzzle is first received by the user, when there is a temporary interruption in power being supplied to an electronic system included in the puzzle and when system firmware is updated or has its operation otherwise interrupted. The disclosure of International Publication No. WO 2019/092648 A1 (the '648 publication) describes that RGB sensing is used to track movement of puzzle-pieces for state-determination. The '648 publication also refers to a capability of determining an "absolute position" of a three dimensional puzzle, that is, determining a state of the puzzle from an unknown state. However, the publication describes that the RGB sensor must be replaced with an image sensor to determine absolute position. The interior surfaces of each piece of the puzzle are provided with a "signature" that can be read optically with the image sensor. However, an image sensor is a more complex sensing device, and consequently, much more expensive than an RGB sensor. Image sensing also requires other sophisticated hardware and increased processing power. Each of the preceding adds to the cost of the device. The increased cost is significant enough that in practice it is unrealistic to include an image sensor in puzzles or other types of consumer products. The '648 publication describes that absolute position can be determined with an RGB sensor but under a much more narrow set of conditions. First, the approach is not suitable for "determining shell segment patterns of three-dimensional puzzles." That is, the approach is not suitable for a cubic puzzle. Second, the approach requires a change in position of the RGB sensor and the surfaces that include the signatures relative to one another. As a result, the absolute position cannot be determined without movement.

Some other approaches require that the user provide the current location of puzzle pieces before using the puzzle following a "cold start" in which the integral electronic system is unaware of the state of the puzzle. This approach places an unwanted burden on the user and eliminates an important benefit of having a smart-puzzle in the first place.

SUMMARY OF INVENTION

Therefore, there is a need for apparatus, systems and methods that provide a puzzle that is aware of its state, solves the next sequence of moves, communicates those moves one by one to the user, and tracks the user's progress towards the next state. Further, there is also need for positional awareness on-board the cube and instinctive user instructions to assist users in solving the puzzle. Embodiments described herein, achieve the preceding while limiting the electronic apparatus and sensing to the core of the puzzle. These embodiments ease the burden placed on the user. For example, they assist the user in learning and memorizing the moves needed to solve the puzzle and provide prompts when needed.

Embodiments described herein also provide an electronic system that is state-aware whenever the puzzle pieces are at rest regardless of whether the system has knowledge of a preceding state of the puzzle and without any movement of the puzzle. Further, some of these embodiments employ only a single RGB sensor to achieve the preceding. Other embodiments employ only two RGB sensors to achieve state-awareness for a puzzle in a static state independent of whether the electronic system has knowledge of the preceding state of the puzzle.

According to one aspect, a cubic puzzle has a plurality of edges and six faces when placed in an overall cubic shape. According to some embodiments, the cubic puzzle includes a core element centrally located within the cubic puzzle, a plurality of puzzle pieces configured to couple to the core element, and an electronic system located in the core element. According to one embodiment, each of the plurality of pieces includes at least one tile included in one of the faces, respectively, with the cubic puzzle located in the overall cubic shape. Each of the plurality of puzzle pieces also includes at least one interior surface having a color selected to provide an identification of an indicia appearing on the at least one tile resulting in the cubic puzzle including a plurality of tiles and a plurality of colored interior surfaces. The electronic system includes a plurality of light sources each associated with one of the plurality of colored interior surfaces, respectively, that is illuminated by the respective one of the plurality of light sources, the plurality of light sources configured to illuminate the plurality of tiles. According to a further embodiment, the electronic system includes at least one RGB sensor configured to sense the color of each of the colored interior surfaces when illuminated by the respective one of the plurality of light sources associated with the selected one of the colored interior surfaces and a processing system coupled to the plurality of light sources and the at least one RGB sensor and configured to receive information from the RGB sensor concerning the sensed color, the processing system determining a location and an orientation around the core element of each of the plurality of puzzle pieces based at least in part on the information. The location and orientation are determined from a single static position with the cubic puzzle placed in the overall cubic shape and independent of information concerning a prior state of the cubic puzzle.

According to another aspect, a method of determining a current state of a cubic puzzle independent of information concerning a prior state of the cubic puzzle is provided where the cubic puzzle includes an exterior including a plurality of tiles each tile including an indicia visible to a user, the cubic puzzle including an interior with a plurality of colored surfaces each having a color selected to provide an identification of the indicia appearing on an associated tile selected from the plurality of tiles, respectively, a plurality of sources of light each of the plurality of sources of light associated with a single one of the plurality of colored surfaces, respectively, and at least one RGB sensor.

According to one embodiment, the method includes, with the cubic puzzle maintained in a first state, an act of (a) illuminating a first colored surface selected from the plurality of colored surfaces with a single source of light selected from the plurality of sources of light because of an association with the first colored surface and sensing a color of the first colored surface with the RGB sensor when the first colored surface is illuminated. According to this embodiment, the method also includes, with the cubic puzzle maintained in the first state, repeating act (a) for each of the plurality of colored surfaces by separately illuminating each of the plurality of colored surfaces with a respective single source of light selected from the plurality of sources of light because of an association between the respective single source of light and the respective colored surface that is being illuminated, and act of processing the colors sensed by the RGB sensor at each of the preceding acts to determine a location and orientation of each of the plurality of tiles with the cubic puzzle in the first state.

According to yet another aspect, a cubic puzzle includes a plurality of edges and six faces when placed in an overall cubic shape. According to some embodiments, the cubic puzzle includes a core element centrally located within the cubic puzzle, a plurality of puzzle pieces configured to couple to the core element and an electronic system located in the core element. According to one embodiment, the core element includes a shell including an outer wall defining a hollow central region and each of the plurality of pieces include at least one tile included in one of the faces, respectively, with the cubic puzzle located in the overall cubic shape. Each of the plurality of puzzle pieces also includes at least one interior surface having a color selected to provide an identification of an indicia appearing on the at least one tile resulting in the cubic puzzle including a plurality of tiles and a plurality of colored interior surfaces each associated with a respective one of the plurality of tiles. The electronic system includes a plurality of light sources each associated with one of the plurality of colored interior surfaces, respectively, that is illuminated by the respective one of the plurality of light sources, the plurality of light sources configured to illuminate the plurality of tiles. According to a further embodiment, the electronic system includes at least one color sensor located in the central hollow region and configured to sense the color of each the colored interior surfaces when illuminated by the respective one of the plurality of light sources associated with the selected one of the colored interior surfaces. A processing system is coupled to the plurality of light sources and the at least one color sensor and configured to receive information from the color sensor concerning the sensed color, the processing system determining a location and an orientation around the core element of each of the plurality of puzzle pieces based at least in part on the information.

The shell is configured to allow light reflected off the plurality of colored interior surfaces to travel through the shell into the hollow central region. The location and orientation are determined from a single static position with the cubic puzzle placed in the overall cubic shape and independent of information concerning a prior state of the cubic puzzle. The plurality of light sources are configured to illuminate selected ones of the plurality of tiles to communicate a visual instruction for solving the cubic puzzle from a current state of the puzzle. According to one embodiment, the outer wall includes light transmission features including at least one of a light guide, a plurality of openings defined in the outer wall, a transparent outer wall and a translucent outer wall.

As used herein the term "color sensor" refers to a light sensing device that collects ambient light information and provides an output concerning the color spectrum of the ambient light that includes three or fewer pixels of information. One of ordinary skill in the art will recognize based on the disclosure provided herein that an RGB sensor is a color sensor. In contrast, one of ordinary skill in the art will also recognize based on the disclosure provided herein that an image sensor is not a color sensor because an image sensor conveys information concerning an array of pixels.

As used herein the term "state-aware" when referring to an electronic system used with a puzzle refers to a condition in which the electronic system can determine a current location and orientation of each piece of the puzzle. Further, one of ordinary skill in the art will recognize based on the disclosure provided herein that the orientation of a puzzle-piece can include a rotational position of the puzzle piece, for example, as the puzzle piece is spun around an axis of rotation.

As used herein the term "tile" means a surface of a puzzle piece that is visible to a user with the puzzle placed in an overall cubic shape. One of ordinary skill in the art will recognize based on the disclosure provided herein that a single puzzle piece can include multiple tiles and that the tiles may include different indicia visible to the user.

As used herein the term "fixed" as it refers to "fixed position tiles" refers to the fact that the tiles are in a fixed location relative to a central hub included in the cubic puzzle. One of ordinary skill in the art will recognize based on the disclosure provided herein that a fixed position tile can spin around its axis while still being in a fixed location relative to the central hub, for example, a center tile in a 3×3×3 cubic puzzle.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 4A illustrates a lighting system in accordance with a first embodiment employed for tile-illumination;

FIG. 4B illustrates the lighting system in accordance with the first embodiment employed for state-detection;

DETAILED DESCRIPTION

Figure 1A:
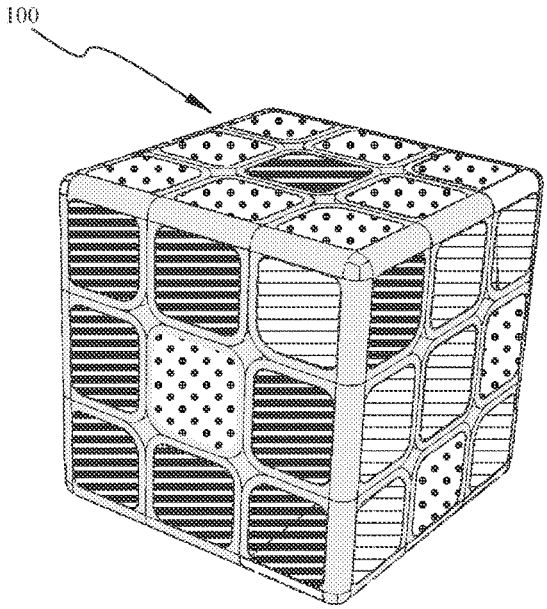
FIG. 1A Prior Art
FIGS. 1A-1B illustrate a cubic puzzle according to the prior art.
Figure 1B:
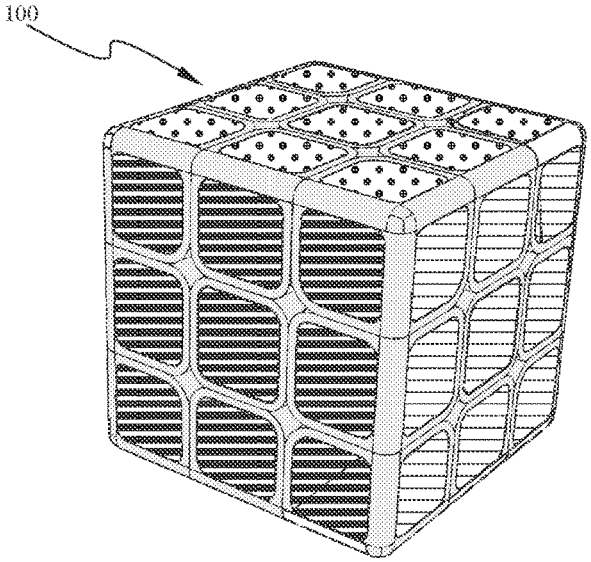
FIG. 1B Prior Art
Figure 2:
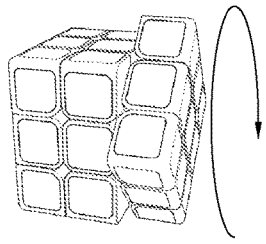
FIG. 2 Prior Art
FIG. 2 illustrates a set of moves available for the cubic puzzle illustrated in FIGS. 1A-1B.
Figure 2:
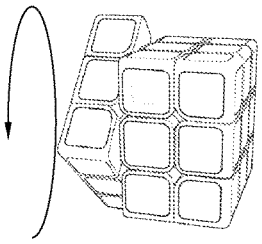
FIG. 2 Prior Art
Figure 2:
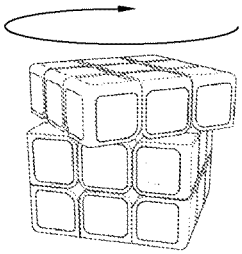
FIG. 2 Prior Art
Figure 2:
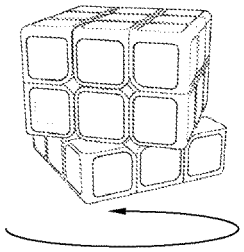
FIG. 2 Prior Art
Figure 2:
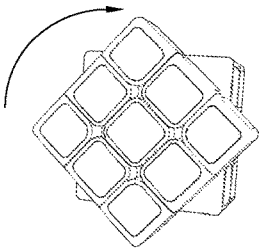
FIG. 2 Prior Art
Figure 2:
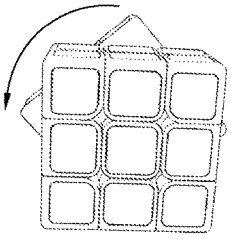
FIG. 2 Prior Art

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Figure 3:
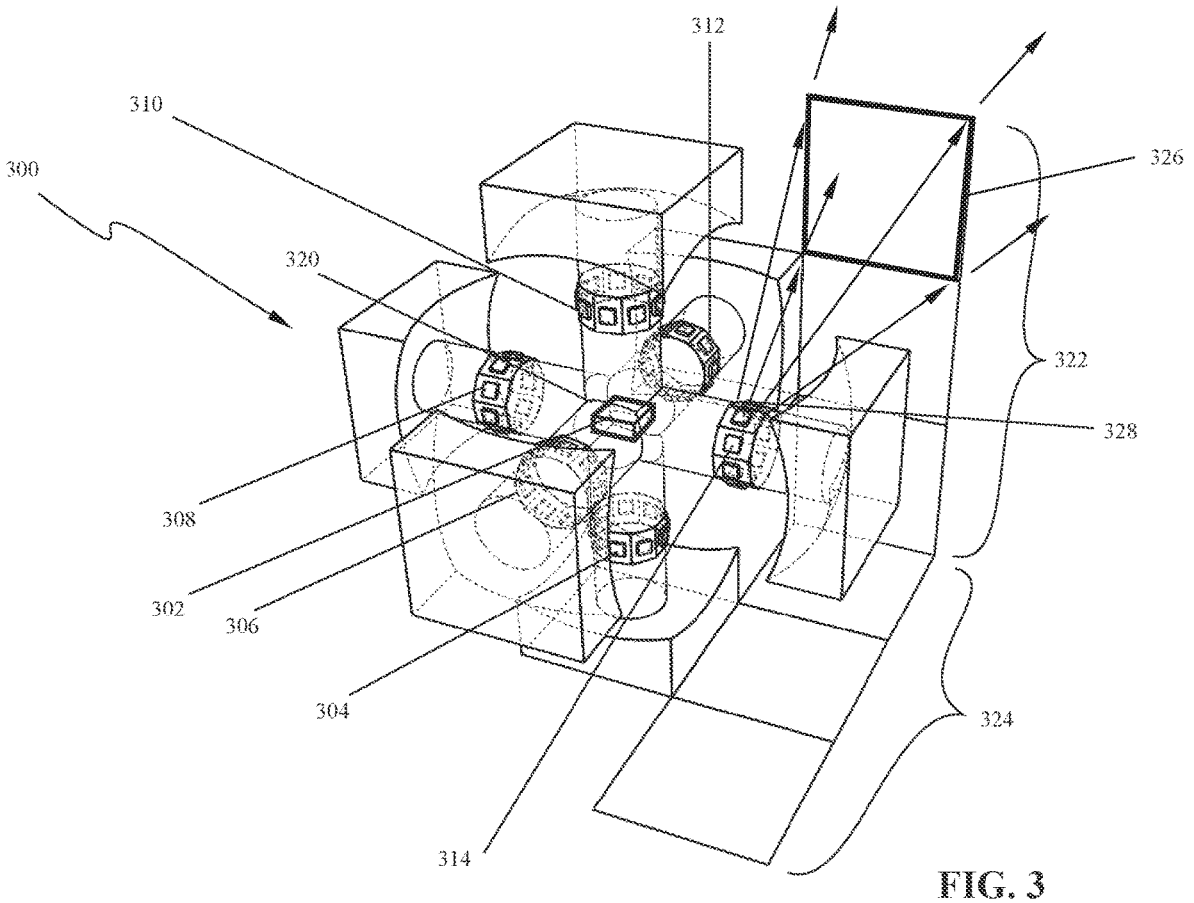
FIG. 3 illustrates a system included in a cubic puzzle in accordance with one embodiment.

Referring now to FIG. 3, a system for illumination for communication and state-detection is illustrated in accordance with one embodiment. The system is included in a central piece 300 located within a cubic puzzle. The system includes an electronic apparatus 302, a first light source 304, a second light source 306, a third light source 308, a fourth light source 310, a fifth light source 312 and a sixth light source 314. The central piece 300 includes a core 320 with six arms (or "axles") extending therefrom. A fixed position tile is located at a distal end of each of the arms. A first set of edge tiles 322 and a second set of edge tiles 324 are illustrated in phantom, respectively. An illuminated tile 326 included in the first set of edge tiles 322 is shown in solid lines. The sets of edge tiles 322, 324 provide a visual reference to better illustrate the location of the system within an overall cubic puzzle when the puzzle is fully assembled.

According to this embodiment, the sets of edge tiles 322, 324 are configured to be rotated about the fixed position tiles located at the distal end of each arm.

According to one embodiment, the various components included in the electronic apparatus 302 are provided in an integral package housed at a single location within the central piece 300, for example, within the core 320. For example, while the light sources 304, 306, 308, 310, 312, 314 are shown as separate distributed components in the illustrated embodiment, they may be included as an integral part of the electronic apparatus 302 housed at the core 320 in other embodiments.

As is described in greater detail with reference to FIG. 9, the electronic apparatus 302 can include one or more of a microcontroller, microprocessor or other processing element, a memory, a power source and one or more color sensors, for example, RGB sensors depending on the embodiment. In further embodiments, the electronic apparatus can include accelerometers or other inertial measurement systems and wireless communication, for example, a Bluetooth communication system.

The light sources 304, 306, 308, 310, 312, 314 each include a plurality of individual light sources, for example, where each of the individual light sources is configured to illuminate a selected tile(s) location. In the illustrated embodiment, the light sources 304, 306, 308, 310, 312, 314 each include a plurality of eight individual light sources, providing a total of 48 individual point sources of light. Depending on the embodiment, each point-source can include a single lighting element such as a single LED or a plurality of lighting elements such as a plurality of LEDs. According to the various embodiments, each point-source of light emits light in at least three color bands, for example, red-green-blue ("RGB"). In one embodiment, the light source is a white LED. In another embodiment, each of the point sources of light includes a laser to project light to the backside of the face of the tiles. The characteristics of the tiles can also employ passive color transforming technologies such as fluorescence, phosphorescence, quantum dots, or interferometric materials. As a result, transmitted color may or may not match internally reflected color. According to one embodiment, the light sources 304, 306, 308, 310, 312, 314 are located as a part of the electronic apparatus 302 in the core 320.

According to the illustrated embodiment, the illuminated tile 326 provides one example of a tile that is illuminated by a point-source 328 included in the light source 314. In one embodiment, each point-source of light is assigned to illuminate an individual tile-position in the cubic puzzle. According to another embodiment, tile-positions are illuminated by more than one point-source of light. In yet another embodiment, each point-source of light is associated with a tile and an interior surface that is also associated with the tile. As is described in detail below, the point-source of light can illuminate the associated interior for state detection and the tile itself to communicate user-instructions. Because each of the fixed position tiles must be capable of rotating for 360 degrees about a longitudinal axis of the respective arm to which they are attached, a joint is provided in each arm distal relative to a location of the respective light source 304, 306, 308, 310, 312, 314. In various embodiments, the arms are each equipped with a combination of electrical contacts and associated resistors to provide a signal that is used to determine the rotational position of the respective arm as is described further with reference to rotation sensors or "shaft encoders" in FIG. 9.

The color sensor included in the electronic apparatus 302 is employed to determine the color of a tile based on light that is reflected from the tile when it is illuminated. The color sensor may include a single color sensor or a plurality of individual sensing elements depending on the embodiment. According to various embodiments, the color sensor includes an RGB sensor.

According to one embodiment, the electronic apparatus includes only a single RGB sensor. According to another embodiment, the electronic apparatus includes only two RGB sensors. For example, where two RGB sensors are employed the output of both color sensors may be employed together to improve redundancy and the processing of the color-sensing signals. Alternatively, a first RGB sensor may be employed to determine a respective color of a first group of tiles included in the puzzle while a second RGB sensor may be employed to determine the color of a second group of tiles included in the puzzle. Further, some embodiments described herein can perform state-sensing without the need to illuminate all of the tiles included in the cubic puzzle. According to these embodiments, the RGB sensor(s) are associated with fewer than all the tile-positions in the cubic puzzle.

In operation, the electronic system 302 employs lighting in two ways. First, the lighting is employed to determine a current state of the cubic puzzle. In particular, the illumination is employed to determine a location and orientation of each of the various puzzle pieces and tile-locations relative to one another. Second, the lighting is employed to communicate movements of puzzle pieces to a user to assist them in solving the puzzle.

Regarding state-determination and the illustrated embodiment, the light sources are directed to respective tile locations. At least a portion of the light is reflected back in a direction of the electronic apparatus 302 and associated color sensor(s). The information provided by the color sensor(s) is processed by the electronic apparatus 302 to determine the color of the tile located at that location in the puzzle. In addition, a portion of the light provided by the light sources transmits through the tiles where it is visible to the user. This illumination provides optical communication that can be used to instruct the user on how to move the puzzle pieces to solve the puzzle, for example, by communicating a direction of rotation of puzzle sections. In some embodiments, the state-detection sampling and the communication may be provided by the same components but performed independently. For example, sampling may be completed very quickly with a low duty cycle that is not noticed by the use. In these same embodiments, the illumination employed for communication is completed more slowly and at a higher lighting-intensity to attract the user's attention. Therefore, in some embodiments the lights sources 304, 306, 308, 310, 312, 314 are directed to a selected tile where some light is transmitted through the tile and other light is reflected back in the direction of the core 320.

Cubic puzzles are generally constructed of hollow pieces that include at least two tiles. Embodiments modify and add features to the puzzle components to assist in communicating light from the light sources 304, 306, 308, 310, 312, 314 to the backside of the tile faces. For example, the routing of light through the internal cube structure can be accomplished a number of ways that may include one or more of: 1) providing clear internal components that allows light to travel through these transparent components; 2) components that include integral light pathways (for example, light guides); 3) fiber optic elements; 4) components that include refractive properties; 5) the use of mirrored surfaces within the cubic puzzle; and 6) the use of lens surfaces within the cubic puzzle, for example, beam focusing optical elements.

There are several ways to resolve the location of the individual tiles to determine the state of the cubic puzzle using tile illumination. According to one embodiment, there is a dedicated LED for all or at least a majority of the tiles included in the cubic puzzle as described above. Further, there can be overlapping light patterns, making use of tile subtraction or addition to resolve an individual tile. In another embodiment, light from a single LED or otherwise reduced quantity of LEDs (relative to the number of tiles) is directed through a programmable LCD surface to selectively block or permit light transmission. According to another embodiment, a mechanical component can be used to selective aim the light sources, for example, a digital lighting processor (DLP) can be employed.

According to some embodiments, a point-source of light may cover multiple tile-positions in a system that is capable of resolving the state of the cubic puzzle and communicating moves to the user. These embodiments can be advantageous because they reduce the parts count and associated manufacturing costs. For example, because the pieces each include at least 2 color tiles, the system can identify pieces and still infer the tile placements. Alternatively, an entire row or column could be covered by the same point-source of light, and by using light duty cycles (of the common row and column), and addition/subtraction, a single tile can be effectively resolved.

FIGS. 4A and 4B illustrate an embodiment including a core element 420. As illustrated, the core element 420 has a polyhedron shape although other shapes may be employed in different embodiments. Referring now to FIG. 4A, the use of a lighting system to communicate information to the user is illustrated in accordance with one embodiment. In some embodiments, the lighting system is employed to communicate moves on the cubic puzzle to the user.

According to the illustrated embodiment, the light sources are included as a part of a core element 420. FIG. 4A illustrates a transmission of light to the face of a tile so that the tile-location is highlighted to the user. The illumination can be used to communicate a variety of information to the user, for example, to instruct the user on a recommended move with the puzzle. In addition, the tile-illumination may be employed to allow an electronic apparatus (for example, electronic apparatus 302) to resolve the current state of the cubic puzzle. That is, to allow the apparatus to determine a location and current position of all of the puzzle pieces and corresponding tile locations and orientations at a given moment in time. FIG. 4A illustrates an embodiment in which some of the light strikes the interior surface of the puzzle and reflects back toward a light sensor located in the core element 420.

According to one embodiment, the illumination and state-determination are performed in substantially real time. In one embodiment, the illumination and state-determination are performed automatically on a periodic basis when the cubic puzzle is in use. According to these embodiments, the illumination is directed to one or a plurality of specific tile locations in the puzzle. The light is transmitted internally within the body of the puzzle. Some portion of the light is reflected off the tile. The reflected-light travels back in the direction of the electronic apparatus where it is detected by the color sensors. The information concerning the reflected light is used by the electronic apparatus to determine a current position of each tile within the cubic puzzle. As described above, according to some embodiments, the state-detection sampling and the communication are provided by the same components but performed independently by controlling the duty cycle and intensity of the lighting source.

Referring now to FIG. 4B, an embodiment that employs the lighting system to illuminate encoded internal puzzle-piece surfaces is illustrated. In FIG. 4B, a core element 420 is illustrated along with a face 430 of the puzzle where the face 430 includes a plurality of tiles 432. For clarity, the entirety of the cubic puzzle including all six faces and fifty-four tiles are not shown. In various embodiments, the core element 420 includes a shell including an outer wall defining a hollow central region. In the illustrated embodiment, the shell includes a plurality of facets 421, for example, planar surfaces. In various embodiments, the shell is configured to allow light reflected off the tiles 432 or plurality of colored interior surfaces to travel through the shell into the hollow central region. These embodiments also allow light transmitted from a light source located within the core element 420 to travel through the shell to illuminate the tiles 432 and/or encoded interior surfaces. Depending on the embodiment, the shell includes light transmission features such as any one of or any combination of a light guide, a transparent wall and a translucent wall.

According to various embodiments, all or a portion of an electronic system is located within the core element 420. Elements of an electronic system illustrated in FIG. 4B include a plurality of light sources 434 and an RGB sensor 436. Other elements and components can be included depending on the embodiment, for example, as described with reference to FIG. 9. In the illustrated embodiment, the plurality of light sources 434 is located on an exterior of the shell provided by the core element 420 while the RGB sensor 436 is located within the hollow central region of the core element 420. According to other embodiments, the plurality of light sources 434 is located on an interior wall of the shell or elsewhere within the core element 420.

A portion of a puzzle piece 438 is also illustrated in FIG. 4B. The puzzle piece 438 includes an inward facing surface 440 with multiple regions. According one embodiment, each piece of the cubic puzzle that can be rotated about the core element 420 includes an inward facing surface with a quantity of encoded regions corresponding to the number of tiles included in the piece. For example, each center-edge piece includes two tiles and an inward facing surface with two encoded regions. Each corner piece includes three tiles and an inward facing surface with three encoded regions. For example, the puzzle piece 438 including the inward facing surface 440 also includes three tiles where each of the encoded regions is associated with a tile, respectively, included in the same puzzle-piece.

In the illustrated embodiment, these regions are separately encoded to include a dotted region, a thinly-lined region and a thickly-lined region where each of these regions is associated with a specific tile. For example, a tile 442 is associated with the thinly-lined region according to the illustrated embodiment. Where the plurality of tiles 432 are identified by the color of the tile, the encoding allows a one-to-one mapping of the location and orientation of each of the plurality of tiles 432. For example, in the illustrated embodiment, the dotted region is representative of a first tile-color, the thinly-lined region is representative of a second tile-color and the thickly-lined region is representative of a third tile-color. For a cubic puzzle, a total of six different colors and corresponding codes are provided. Where an alternate form of indicia (other than color) is provided on the tile, the six different codes are employed where each code is representative of one of the six different indicia employed to identify like-tiles. For example, depending on the embodiment, the indicia can include any one of or any combination of: a color, a pattern, a design element, a symbol, an alpha character and a numeric character.

According to this embodiment, the construction of the cubic puzzle establishes a fixed association between each encoded region and a specific tile. The association is fixed because the tile and the encoded region are part of the same puzzle-piece, for example, the puzzle piece 438. Consequently, the tiles and the puzzle-piece in which they are included move around the core element 420 together. In contrast, each light source included in the plurality of light sources 434 is in a fixed location relative to the core element 420 and the various tile-locations located about the core. However, the relative position of each light source to specific tiles changes as the puzzle pieces are rotated about the core element 420.

In general, these embodiments illuminate a selected encoded region of an inward facing surface with a selected one of the light sources to map a location of a tile. With a specific quantity of tiles mapped the state of the cubic puzzle is determined by the electronic system included in the puzzle. The approach provides the advantage of being state-aware independent of any knowledge of a prior state of the puzzle. Further, the preceding is achieved with the puzzle in a static position, that is, there is no need to move any of the puzzle-pieces to determine the current state.

According to the embodiments illustrated in FIGS. 4A and 4B, one the plurality of light sources such as a single LED is associated with each tile-position of the cubic puzzle, respectively. For example, each of the square shaped facets is directed to a center-edge location of the cubic puzzle and each triangle shaped facet is directed to a corner piece. Because each center-edge piece includes two tiles, each square facet includes two LEDs where each LED is associated with one of two tile positions of the cube, respectively. Because the corner pieces include three tiles, each of the triangle shaped pieces includes three LEDs where each LED is associated with one of three tile positions of the cube, respectively.

Figure 8:
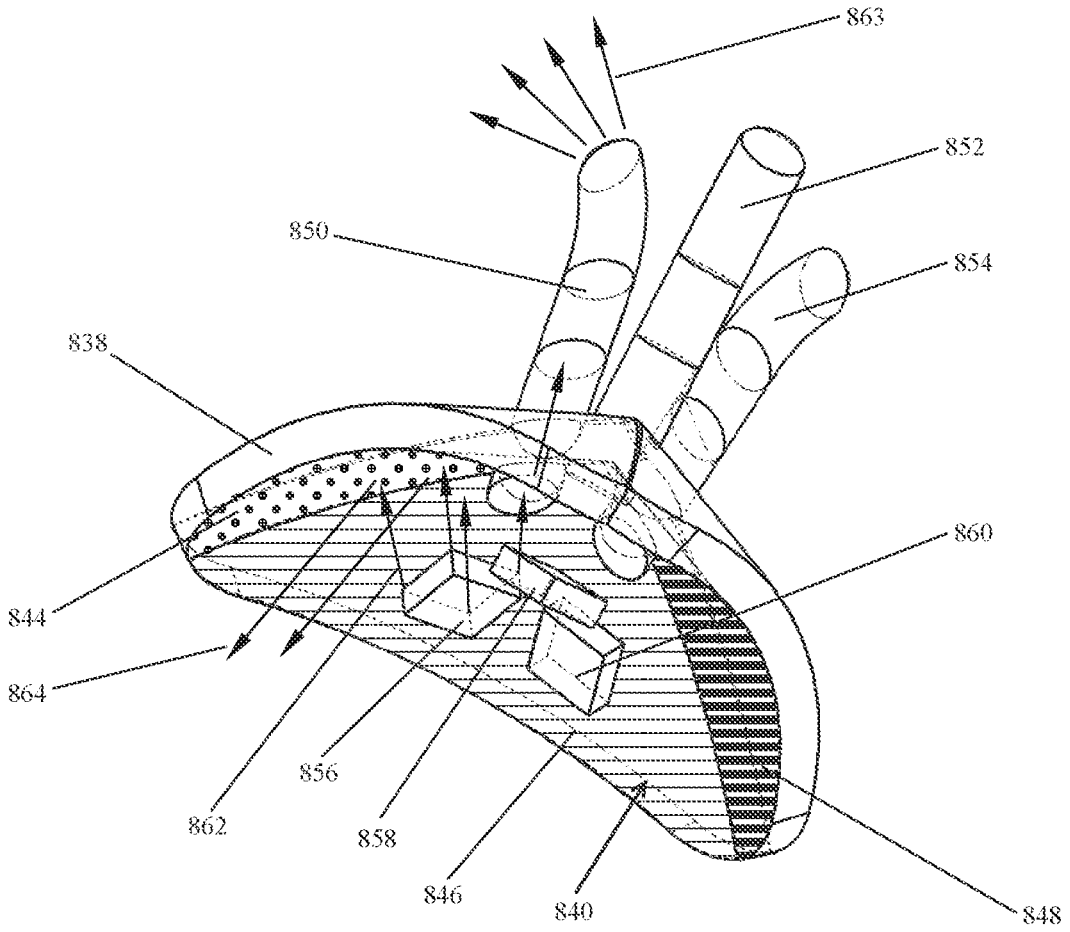
FIG. 8 illustrates a portion of a piece of a cubic puzzle in accordance with one embodiment.

Referring now to FIG. 8, a puzzle piece 838 which is included in a larger puzzle piece that includes three tiles is illustrated in accordance with one embodiment. The puzzle piece 838 includes an inward facing surface 840 with a first encoded region 844, a second encoded region 846 and a third encoded region 848. The puzzle piece 838 also includes a first light guide 850, a second light guide 852 and a third light guide 854. FIG. 8 also illustrates a first light source 856, a second light source 858 and a third light source 860. Light transmitted from the first light source 862 is illustrated including transmitted light exiting the first light guide 863 and transmitted light reflected off the first encoded region 864. The light sources 856, 858, 860 included in FIG. 8 are located at the core element (for example the core element 420 illustrated in FIG. 4B) and are not a part of the puzzle piece 838. In the operation of a fully assembled puzzle, the puzzle piece 838 is moved about the central piece including the core element such that it is located adjacent a different combination of light sources when moved from a first corner of the puzzle to a second corner of the puzzle.

According to this embodiment, the puzzle piece 838 is representative of an approach that is applied throughout the cubic puzzle. That is, encoded inward facing surfaces are included in each piece of the puzzle that can be moved around the central piece of the puzzle to change a face in which one or more of the tiles included in the piece appears. According to one embodiment, each center-edge puzzle piece and each corner puzzle piece includes the encoded inward facing surface. In these embodiments, each center edge piece includes two tiles and each corner piece includes three tiles. To provide a direct association between each of these tiles and a corresponding one of the encoded surfaces, each center-edge piece includes two encoded regions on the inward facing surface and each corner piece includes three encoded regions on the inward facing surface. The preceding is unnecessary for the center tile in each face because each center tile is in a fixed location in a face, respectively.

The "encoding" that is employed on the inward facing surfaces of the puzzle pieces is selected such that the encoding results in a detectable difference in the color spectrum of light reflected off of the surface relative to the color spectrum of light reflected off of surfaces that include a different "code." For example, codes can include any of selected colors, color-combinations and patterns. According to one embodiment, the quantity of codes that are employed matches the quantity of faces in the puzzle. According to this embodiment, a cubic puzzle employs six different codes because it includes six faces. For example, where the indicia on the tiles include one of six colors, the encoded surfaces can include one of six codes where each code is associated with one of the six colors, i.e., six color channels are employed.

According to the illustrated embodiment, the light sources 856, 858, 860 are employed for both state-detection and tile illumination. That is, the light sources 856, 858, 860 can be used to illuminate the inward facing surface 840 to provide reflected light used to determine a location of a puzzle piece and also to illuminate the inward side of a tile such that the tile appears illuminated when viewed by the user. The light guides 850, 852, 854 are employed to conduct light from the light sources 856, 858, 860, respectively, to the tile-location associated with the respective light. For example, the first light guide 850 conducts light from the first light source 856; the second light guide 852 conducts light from the second light source 858; and the third light guide 854 conducts light from the third light source 860.

As illustrated, the first light source 856 is on and transmitting light 862. A first portion of the transmitted light 862 is conducted via the first light guide 850 as the transmitted light 863 to an exterior side of the puzzle piece 838 to illuminate the tile-location associated with the first light source 856. In this example, the tile associated with the first encoded region 844 is presently at that tile-location. Consequently, the first light source 856 is employed to illuminate that tile with the transmitted light 863. According to these embodiments, the illumination of the tile is apparent to the user when viewing an exterior of the puzzle provided that the duty cycle and intensity of the first light source 856 are controlled to achieve the preceding. In addition, a second portion of the transmitted light 862 results in the transmitted light reflected off the first encoded region 864. The reflected light 864 is transmitted back toward the core element in which the first light source 856 is located. An RGB sensor also included in the core element detects the color spectrum of the reflected light 864 for use in determining a current state of the cubic puzzle including a known location and orientation determined for the tiles associated with the puzzle piece 838. In various embodiments, the duty cycle and intensity of the first light source 856 are controlled such that the illumination of the first encoded region 844 does not transmit the transmitted light 863 via the first light guide 850 in a manner that is visible to the user when the state-detection illumination is active. A similar operation can be performed for each of the second encoded region 846 and the third encoded region 848 with the second light source 858 and the third light source 860, respectively. In this manner repeated for others of the puzzle pieces, a location of the tiles associated with each puzzle piece can be determined.

Figure 5:
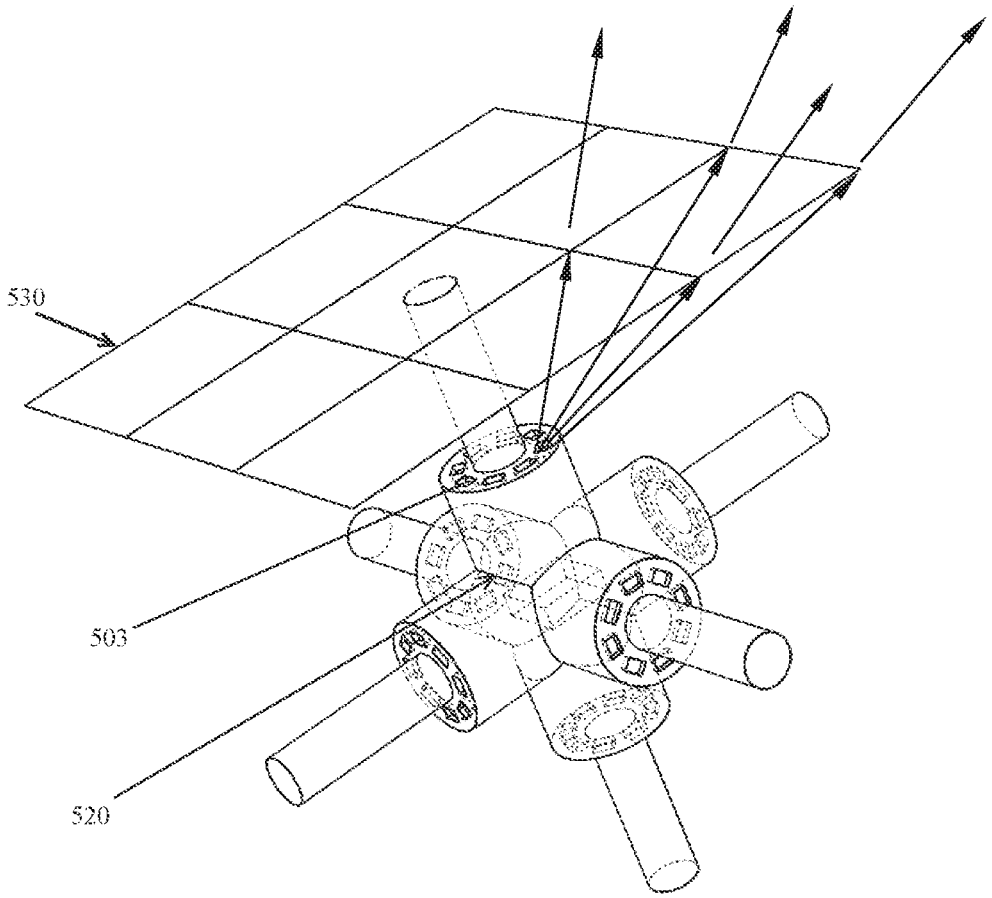
FIG. 5 illustrates a lighting system in accordance with a second embodiment.

FIGS. 3 and 4A-4B illustrate placement of the light sources at two different locations within the cubic puzzle, respectively. FIG. 5 illustrates a further embodiment for placing the light sources and an approach for assigning light sources and individual point-sources of light included in the light sources for illumination of specific tile locations. In FIG. 5, a core element 520 is illustrated along with an external face 530 of the puzzle where the external face 530 includes a plurality of tiles.

According to FIG. 5, a light source 503 is located on an internal face that is substantially perpendicular to the arm on which it is located. In general, the light source 503 is located on a plane that directs the light source toward a selected tile. As a result, the light sources located on the internal face point radially outward relative to the hub and directly at the tile locations at the end of the arm on which the light source is located. According to this embodiment, the light source 503 includes a plurality of point-sources of light. In general and in various embodiments, the point-sources of light are oriented on individual planes to aim each point-source directly at a specific tile-location. The overall shape of the structure on which the light sources are located can be planar, spherical or an alternate shape to achieve the preceding depending on the embodiment. Because eight tile positions on the external face 530 are locations in which different tiles can appear, the light source 503 includes eight point-sources of light, for example, eight LEDs. In this embodiment, each point-source is assigned a specific tile location in the external face 530 at which the light source is directed.

Figure 6:
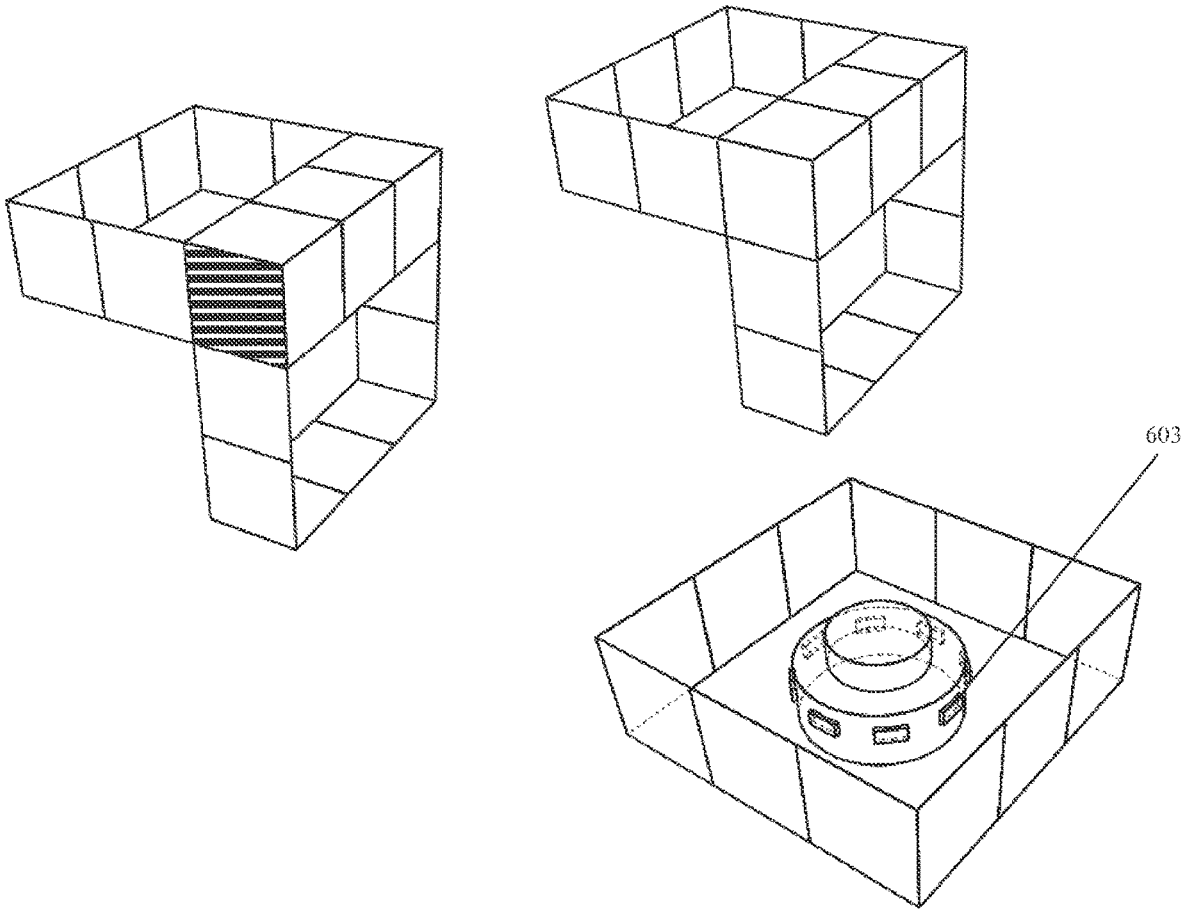
FIG. 6 illustrates a lighting system in accordance with a third embodiment.

FIG. 6 illustrates an alternate embodiment for placing the light sources and an approach for assigning light sources and individual point-sources of light for illumination of specific tile locations. In FIG. 6, a light source 603 is located on each arm. A plurality of point-sources of light are located 360 degrees about the longitudinal axis of the arm. The light source 603 is directed radially outward relative to the longitudinal axis of the arm. According to this embodiment, the point-sources of light are assigned axially to specific tile location. As illustrated in FIG. 6, the light source 603 has point-sources of light directed to four sides of the cubic puzzle. According to this embodiment, each light source 603 can illuminate a total of twelve tile positions if desired because the light source is oriented to illuminate three tiles on fours faces of the puzzle. As a result, there is some redundancy in the available lighting and some point-sources may be unassigned.

Figure 7A:
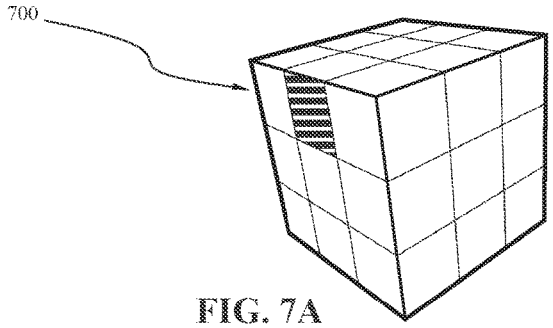
FIG. 7A-7D illustrate visual prompts in accordance with one embodiment.
Figure 7B:
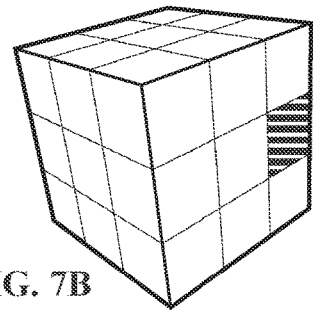

FIGS. 7A-7D illustrate an embodiment in which tile illumination visible to the user is employed to convey user instructions. According to an illustrated embodiment, FIG. 7A highlights a current position of a tile (shaded). FIG. 7B illustrates a position of the same tile (also shaded) that will assist the user in solving the puzzle provided the user moves the tile from the current position to the position illustrated in FIG. 7B. According to this embodiment, the state-awareness of the system and optical communication allow the system to identify the change in tile location, to identify the move or moves that will change the location as desired and to communicate the move(s) to the user.

In operation, the tile to be moved can be identified to the user by illumination, for example, as shown in FIG. 7A. The position of the tile following completion of the move can also be identified to the user as shown in FIG. 7B. The nature and type of illumination, for example, solid-on for a fixed interval, blinking at a known rate, etc. can be established to convey a particular type of information. For example, a first type of illumination can be employed to identify the tile to move and a second type of illumination can be employed to identify the destination-location of the same tile. According to one embodiment, a "negative" is used to communicate information to the user. Thus, the preceding example can illuminate the entire cube but for the tile to move followed by illumination of the entire cube but for the destination-location of the same tile.

Figure 7C:
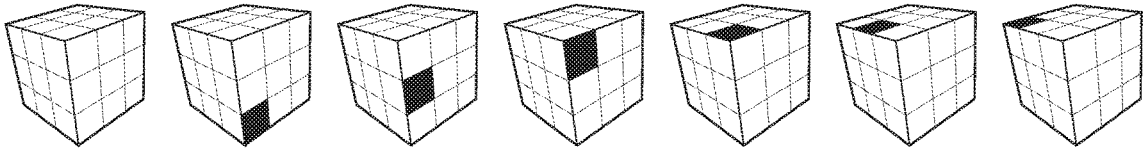
Figure 7D:
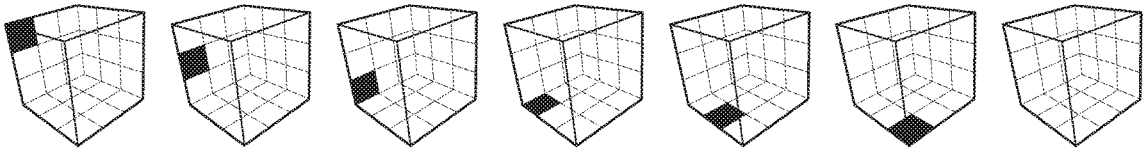

FIGS. 7C and 7D illustrate how the system can be employed to identify to the user the piece that needs to be rotated next to complete a move to relocate the tile from its current position to the desired location. In the illustrated embodiment, a counter clockwise rotation of the set of tiles located on the left hand face of the cubic puzzle is a first move. The system 300 conveys this to the user by a relatively rapid sequential illumination of the tiles that are immediately adjacent the face to be rotated. To further assist the user, the direction of rotation is established to illustrate the desired direction of rotation (in this example counter clockwise).

Figure 9:
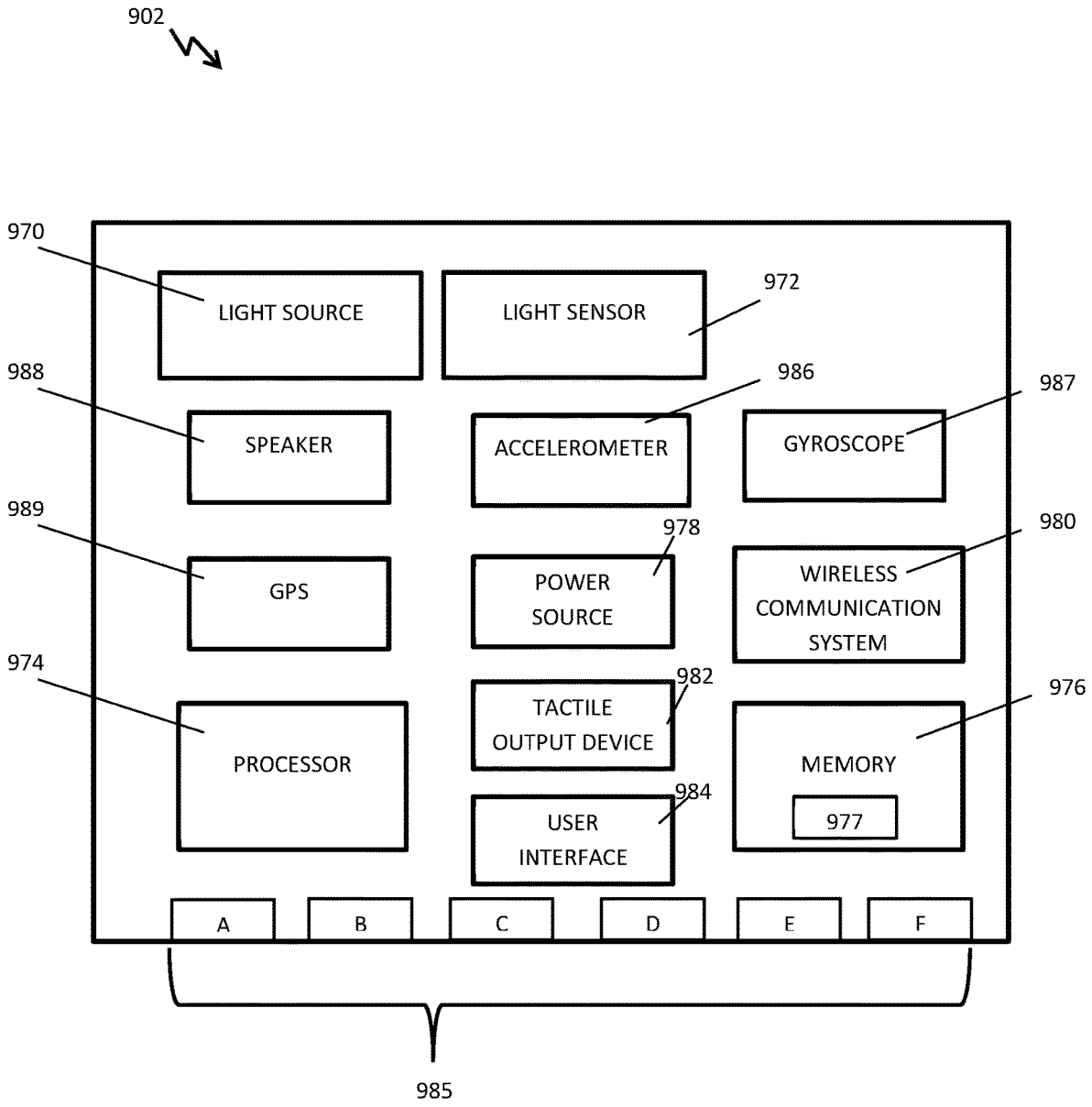
FIG. 9 illustrates a block diagram of an electronic system for inclusion in a cubic puzzle in accordance with various embodiments.

Referring now to FIG. 9, an electronic system 902 is illustrated in accordance with various embodiments. For example, any one or any combination of the elements included in the electronic system 902 can be included in the embodiments illustrated and described with reference to FIGS. 3-8 depending on the embodiment.

According to the illustrated embodiment, the electronic system 902 includes a light source 970, a light sensor 972, a processor 974, a memory 976, a power source 978, a wireless communication system 980, a tactile output device 982, a user interface 984, a plurality of shaft rotational sensors 985, an accelerometer 986, a gyroscope 987, a speaker 988 and a GPS 989. The electronic system 902 can include one or more power busses and one or more communication busses. The communication busses can be used for the communication of instructions/commands and data between the illustrated components and between the illustrated components and other components included in the device depending on the embodiment.

The light source 970 can include a plurality of individual sources of illumination, for example, LEDs or other light sources. An association can be made between each individual light source and a selected tile-location relative to the central piece of the cubic puzzle. In these embodiments, the association is established such that the respective light sources are associated with the tile-location that the light source illuminates. Depending on the embodiment, the individual light sources can each include a single lighting element such as a single LED or a plurality of lighting elements such as a plurality of LEDs. According to the various embodiments, each light emits light in at least three color bands, for example, red-green-blue ("RGB"). In one embodiment, the light source is a white LED.

In various embodiments, the light sensor 972 operates to sense the color of light reflected from an encoded interior surface when illuminated, an interior surface of the tile when illuminated or a combination of both. According to various embodiments, the color sensor includes one or more RGB sensor(s). According to one embodiment, the electronic apparatus includes only a single RGB sensor that is employed to determine the color of any of the tiles and/or associated encoded regions included in the puzzle and illuminated by the light source 970. According to another embodiment, the electronic apparatus includes only two RGB sensors that are employed to sense the color of any of the tiles and/or associated encoded regions included in the puzzle and illuminated by the light source 970. Some embodiments described herein can perform state-sensing without the need to illuminate all of the tiles included in the cubic puzzle. In these embodiments, the location and orientation of all of the puzzle pieces can be derived by illuminating fewer tiles. For example, in one embodiment, the state of a cubic puzzle including 54 tiles is determined by illuminating 47 of the tiles. In another embodiment, only 46 of the tiles are illuminated.

Depending on the embodiment, the processor 974 can include one or more of a microcontroller, microprocessor or other processing element. According to one embodiment, the processor is a NRF52 processor from Nordic semiconductor. According to this embodiment, the processor includes an integral BLUETOOTH low energy wireless communication system. In general, the processor executes stored instructions to control the output of the light source 970, process information provided by the light sensor 972, employ the information to establish a current state of the cubic puzzle and provide puzzle solving instructions or other feedback to the user. The processor 974 operates to perform other functions and operations depending on the embodiment. For example, the processor 974 can operate to process audio inputs, for example, commands, instructions or prompts.

The memory 976 is configured to store software instructions 977 in accordance with various embodiments. The software instructions can include one or more algorithms or other programs, for example, state-detection algorithms. As further examples, the memory can be programmed with software that when executed by the processor: controls an operation of the power source 978 including the on/off state of the system; controls recharging of the power source 978; and controls the output of the individual lights included in the light source 972. In one embodiment, the memory 976 is included in the processor 974. In another embodiment, the memory 976 includes memory internal to the processor 974 and memory external to the processor 974.

The power source 978 can include one or more batteries, for example, lithium or alkaline batteries. Further, the power source 978 can include a replaceable power source or a rechargeable power source depending on the embodiment. Where a rechargeable power source is employed, the power source 978 can include recharging circuitry to regulate charging operations. The recharging circuitry can include a wired electrical connection that extends from the core to one of the tiles included in the central piece of the cubic puzzle. For example, a recharging port can be located at a surface of such a tile. In one embodiment, a recharging port is included in the system in a location that is accessed by at least a partial disassembly of the cubic puzzle. According to another embodiment, wireless inductive charging is used to recharge the power source 978 included in the electronic apparatus 902.

Depending on the embodiment, the wireless communication system 980 can include BLUETOOTH, BLUETOOTH LE or Wi-Fi communication. The wireless communication system 980 can be included as a standalone element or included in the processor 974 as described above. Depending on the embodiment, the wireless communication system 980 can operate to communicate with a user's personal electronic device when the puzzle is in use or to connect to a wide area network to receive software updates as two examples.

The tactile output device 982 can provide various types of user feedback depending on the embodiment. The tactile output device 982 can include a motor to provide vibrations where a selected pattern, speed or force of vibration is associated with a pre-determined notification or alert to the user. For example, the tactile output device 982 may operate to signal to the user that the electronic system 902 is turning on or off. According to this embodiment, two different types of vibration can be provided one for each of the respective changes in the operating state of the electronic system 902.

The user interface 984 can vary depending on the embodiment. According to one embodiment, the user interface 984 includes any one or any combination of indicating lights (for example, LEDs) to provide information concerning the operational status of the electronic system 984. For example, the user interface 984 can communicate to the user an on/off state, a battery status and the status of wireless communication (i.e., whether the electronic system 984 successfully paired with a corresponding portable electronic device). According to one embodiment, the user interface 984 includes a display to display status information to the user. In further embodiments, the user interface 984 receives user inputs and can include, for example, buttons, sliders or switches.

According to the illustrated embodiment, the plurality of shaft rotational sensors 985A-985F includes one rotational sensor for each axle included in the cubic puzzle where a single puzzle piece including a tile rotatable around the longitudinal axis of the axle is located at the distal end of each axle. The shaft rotational sensors 985A-985F are employed to sense the movement of the pieces of the puzzle. According to some embodiments, the plurality of shaft rotational sensors 985A-985F provide the electronic system 902 with an ability to determine the puzzle state through one or a plurality of puzzle movements provided that the system knows the puzzle-state from which the moves began. That is, the plurality of shaft rotational sensors 985A-985F are suitable for tracking relative movement of the puzzle pieces. According to these embodiments, a further illumination for state-determination is not required after an initial state is determined via the illumination, for example, the illumination process as described with reference to FIG. 10. According to one embodiment, each center piece is equipped with a brush contact that rotates through different resistor values one for each of the four rotational positions of the puzzle piece and associated tile. In various embodiments, the plurality of shaft rotational sensors 985A-985F is employed for high speed turn tracking of the puzzle pieces. According to some embodiments, the electronic system 902 includes six or fewer shaft rotational sensors.

In some embodiments, the electronic system 902 includes an inertial measurement system including either or both of the accelerometer 986 and the gyroscope 987. According to some embodiments, the accelerometer 986 is employed as an input device that operates to sense user input. For example, the accelerometer 986 can sense when the cubic puzzle is shaken or tapped. When shaken the accelerometer can sense a pattern with which the puzzle is shaken, and when tapped, the number of taps. The preceding can be used to provide a specified operational response form the puzzle based on the user input sensed by the accelerometer 986. For example, the user can provide a double tap or other tap sequence to request a puzzle-solving hint. The accelerometer 986 can also sense when the puzzle is dropped and begins to free fall, for example, a user can toss the puzzle into the air to activate the electronic system. According to one embodiment, the accelerometer 986 includes a multi-axis accelerometer. In some embodiments, the gyroscope 987 can be employed to determine a relative orientation of the puzzle. This information can be employed to assist in selecting one or more faces of the cubic puzzle in which to provide visual notifications to the user.

The speaker 988 can be employed to provide audio notifications or alerts to the user. For example, selected audio notifications can be associated with various stages of progress in solving the cubic puzzle, or alerts if the user makes an error by failing to follow a hint displayed to the user via an illumination of selected tiles. In one embodiment, the speaker 988 can provide audio instructions or hints concerning the movement of puzzle pieces to solve the puzzle.

Depending upon the embodiment, the GPS 989 can be employed either alone or in combination with the user's portable electronic device to establish a location of the cube for the purpose of activating location-based features or alerts. For example, the location information may be employed to assist the user in connecting with other users who have a cubic puzzle to promote interaction and assist users in improving their skill in solving the puzzle.

In some embodiments, the elements are included in the electronic system 902 can be located in the central piece of the cubic puzzle, for example, the central piece 300. In one embodiment, all of the elements of the electronic system 902 are included with the core element, for example, the core element 420. In other embodiments, elements of the electronic system 902 can be distributed in different regions of the central piece.

Figure 10:
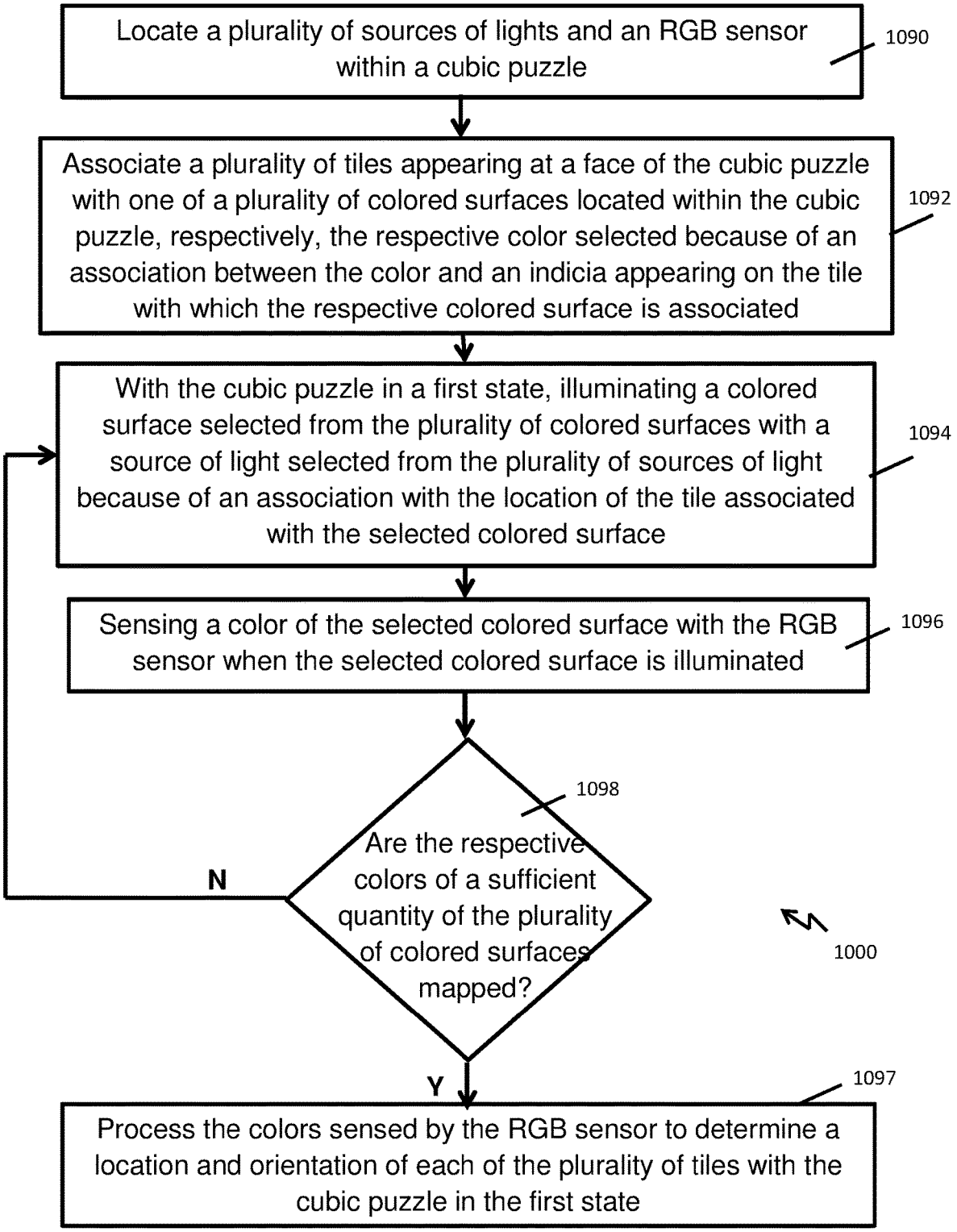
FIG. 10 illustrates a flow diagram of a process for determining a state of a cubic puzzle in accordance with one embodiment.

Referring now FIG. 10, a flow diagram of a process 1000 for employing an electronic system to determine a state of a cubic puzzle with the puzzle in a static state and independent of whether or not the electronic system has knowledge of a prior state of the puzzle. The process 1000 illustrates a series of operations that can be employed to serially illuminate surfaces located within the cubic puzzle, sense the color of light reflected at each act of illumination and determine a location and orientation of each of the plurality of tiles base on the color of the reflected light.

In FIG. 10, the following operations are included in the process 1000: locating a plurality of sources of light and an RGB sensor within a cubic puzzle 1090; associating the tiles included in the cubic puzzle with surfaces located within the puzzle 1092; illuminating an internal surface with the puzzle in a first state 1094; sensing a color of the selected internal surface when illuminated 1096; and processing the sensed-colors to determine a location and orientation of all of the tiles included in the puzzle 1097. According to the illustrated embodiment, the process 1000 also includes a decision point: determining whether a sufficient quantity of the internal surfaces are mapped 1098 such that the state of the puzzle can be determined.

The process 1000 begins at the act of locating a plurality of sources of light and an RGB sensor within a cubic puzzle 1090. Here, an electronic system is integrated into the cubic puzzle such that the plurality of light sources (for example, LEDs) and at least one RGB sensor are included within the cubic puzzle, for example, in various embodiments as illustrated and described with reference to FIGS. 3-9. According to one embodiment, a light source is provided for all of the tile-locations included in the puzzle, respectively. According to other embodiments, a respective light source is provided for fewer than all of the tile-locations included in the puzzle.

The process 1000 moves to the act of associating the tiles included in the cubic puzzle with surfaces located within the puzzle 1092. For example, an association can be created between one of the plurality of the tiles appearing at a face of the cubic puzzle and one of a plurality of colored surfaces located within the puzzle where the respective color of the internal surface is selected because of an association between the color and an indicia appearing on the tile with which the respective colored surface is associated.

The process 1000 moves to the act of illuminating a colored surface selected from the plurality of colored surfaces with a source of light selected from the plurality of sources of light because of an association between the selected light and the location of the tile associated with the selected colored surface 1094. This act is performed with the cubic puzzle in a first state.

With the cubic puzzle maintained in the first state, the process moves to the act of sensing a color of the selected internal surface with the RGB sensor when the selected internal surface is illuminated 1096. Depending on the embodiment, the internal surfaces can be encoded to reflect light having different color spectrums by providing the internal surface with a selected color, a selected pattern or a combination of the preceding.

Following the color sensing completed at the act 1096, the process 1000 moves to an act of determining whether a sufficient quantity of the internal surfaces are mapped 1098. This determination is evaluated based on whether a location of enough of the internal surfaces are mapped for the electronic system to determine a location of all of the tiles included in the cubic puzzle with the cubic puzzle in the first state. If additional mapping is required, the process 1000 repeats the act of illuminating an internal surface with the puzzle in a first state 1094 and sensing a color of the selected internal surface when illuminated 1096 until a sufficient quantity of the internal surfaces are mapped.

When a sufficient quantity of the internal surfaces are mapped, the process moves to the act of processing the sensed-colors to determine a location and orientation of all of the tiles included in the puzzle 1097. Here, the colors sensed by the RGB sensor at each occurrence of the act of sensing 1096 are processed to determine the location and orientation of each of the plurality of tiles with the cubic puzzle in the first state.

While the term "illuminated" is employed to describe a tile that receives light from one or more of the light sources, the illumination may or may not be visible to the user depending on the embodiment. For example, illumination that operates to allow the system to determine a state of the cubic puzzle may be imperceptible to the user. That is, the duty cycle can be controlled to provide lighting for a sufficient time to determine a puzzle state but rapid enough to be imperceptible. Further, the lighting intensity used for state-detection can also be controlled to assist in making illuminating for that purpose imperceptible to the user. In another embodiment, the frequency of the light used for illumination for state-detection is outside the range visible to the human eye.

The embodiments described above primarily describe a system that provides users with a stand-alone state-monitoring and feedback system that does not require an interface with any external components. According to an alternate embodiment, one or more elements of the system can be provided in hardware or software included in a mobile device, for example, a tablet or smartphone. For example, these embodiments may allow communication with another device to provide communication between the cubic puzzle and the outside world as well as provide assistance in solving the puzzle. According to one version, at least a portion of the system is provided in a mobile app, for example, an app that receives feedback from hardware included in the cubic puzzle.

In some embodiments, the above description includes reference to a tile with an identifiable color visible to the user where the cubic puzzle is solved when each face of the puzzle only includes tiles of the same color. However, in various embodiments, other indicia may be employed to establish groups of like-tiles. For example, depending on the embodiment, the indicia can include any one of or any combination of: a color, a pattern, a design element, a symbol, an alpha character, a numeric character or other visual distinct element.

While shown and described with reference to a 6 sided cubic-shaped object including 9 tiles a side, embodiments described herein can be employed with puzzles having different sizes, shapes and configurations.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A cubic puzzle including a plurality of edges and six faces when placed in an overall cubic shape configurable in a solved state and a plurality of unsolved states, the cubic puzzle comprising:

a core element centrally located within the cubic puzzle;

a plurality of puzzle pieces configured to couple to the core element, each of the plurality of pieces including at least one tile included in one of the faces, respectively, with the cubic puzzle located in the overall cubic shape, each of the plurality of puzzle pieces includes at least one interior surface having a color selected to provide an identification of an indicia appearing on the at least one tile resulting in the cubic puzzle including a plurality of tiles and a plurality of colored interior surfaces; and an electronic system located in the core element, the electronic system including:

a plurality of light sources each associated with one of the plurality of colored interior surfaces, respectively, that is illuminated by the respective one of the plurality of light sources, the plurality of light sources configured to illuminate the plurality of tiles;

at least one color sensor configured to sense the color of each of the colored interior surfaces when illuminated by the respective one of the plurality of light sources associated with the selected one of the colored interior surfaces; and a processing system coupled to the plurality of light sources and the at least one color sensor and configured to receive information from the at least one color sensor concerning the sensed color, the processing system determining a location and an orientation around the core element of each of the plurality of puzzle pieces based at least in part on the information, wherein the location and orientation are determined from a single static position with the cubic puzzle placed in the overall cubic shape in any of the plurality of unsolved states and independent of information concerning a prior state of the cubic puzzle.

2. The cubic puzzle of claim 1, wherein each interior surface is illuminated in-turn by the respective one of the plurality of light sources associated with the interior surface.

3. The cubic puzzle of claim 2, wherein the plurality of puzzle pieces include:

a plurality of central pieces each located in a middle of one of the faces, respectively, the central pieces having a fixed location about the core element relative to one another;

a plurality of corner pieces; and a plurality of edge pieces each located in a middle of one of the plurality of edges, respectively, wherein the illumination includes an illumination of at least the plurality of corner pieces and the plurality of edge pieces.

4. The cubic puzzle of claim 1, wherein the indicia includes at least one of a color, a pattern, a design element, a symbol, an alpha character and a numeric character.

5. The cubic puzzle of claim 1, wherein the plurality of light sources are configured to illuminate selected ones of the plurality of tiles to communicate a visual instruction for solving the cubic puzzle.

6. The cubic puzzle of claim 2, wherein the core element includes a shell including an outer wall defining a hollow central region, and wherein the electronic system includes the plurality of light sources secured to the outer wall.

7. The cubic puzzle of claim 6, wherein the shell is configured to allow light reflected off the plurality of colored interior surfaces to travel through the shell into the hollow central region, and wherein the outer wall includes light transmission features including at least one of a light guide, a plurality of openings defined in the outer wall, a transparent outer wall and a translucent outer wall.

8. The cubic puzzle of claim 7, wherein the at least one color sensor includes a plurality of color sensors, and wherein the electronic system includes a circuit board located within the hollow central region, the circuit board having the plurality of colors sensors secured thereto.

9. The cubic puzzle of claim 8, wherein the plurality of color sensors includes two RGB sensors.

10. A method of determining a current state of a cubic puzzle, the cubic puzzle configurable in an overall cubic shape in any of a solved state and a plurality of unsolved states, the cubic puzzle having an exterior including a plurality of tiles each tile including an indicia visible to a user and an interior with a plurality of colored surfaces each having a color selected to provide an identification of the indicia appearing on an associated tile selected from the plurality of tiles, respectively, a plurality of sources of light each of the plurality of sources of light associated with a single one of the plurality of colored surfaces, respectively, and at least one color sensor, the method comprising:

(a) with the cubic puzzle maintained in a first unsolved state included in the plurality of unsolved states, illuminating a first colored surface selected from the plurality of colored surfaces with a single source of light selected from the plurality of sources of light because of an association with the first colored surface and sensing a color of the first colored surface with the color sensor when the first colored surface is illuminated;

(b) with the cubic puzzle maintained in the first unsolved state, repeating act (a) for each of the plurality of colored surfaces by separately illuminating each of the plurality of colored surfaces with a respective single source of light selected from the plurality of sources of light because of an association between the respective single source of light and the respective colored surface that is being illuminated; and (c) processing the colors sensed by the color sensor at each of acts (a) and (b) to determine a location and orientation of each of the plurality of tiles with the cubic puzzle in the first unsolved state wherein the location and orientation are determined from a single static position with the cubic puzzle placed in the overall cubic shape in any of the plurality of unsolved states and independent of information concerning a prior state of the cubic puzzle.

11. The method of claim 10, wherein the plurality of tiles includes all tiles included in the cubic puzzle.

12. The method of claim 10, further comprising repeating act (b) for a subset of tiles including fewer than all tiles included in the plurality of tiles.

13. The method of claim 10, further comprising illuminating selected ones of the plurality of tiles to communicate a visual instruction for solving the cubic puzzle from the current state of the puzzle.

14. The method of claim 10, further comprising performing acts (a) and (b) with at least one of a rate-of-illumination and an intensity-of-illumination such that illumination of the plurality of tiles performed at acts (a) and (b) is substantially undetectable to a user viewing the cubic puzzle.

15. The method of claim 10, wherein the cubic puzzle includes a processing device, and wherein the method further comprises automatically performing acts (a) and (b) following an update to software operating on the processing device.

16. A cubic puzzle including a plurality of edges and six faces when placed in an overall cubic shape configurable in a solved state and a plurality of unsolved states, the cubic puzzle comprising:

a core element centrally located within the cubic puzzle, the core element including a shell including an outer wall defining a hollow central region;

a plurality of puzzle pieces configured to couple to the core element, each of the plurality of pieces including at least one tile included in one of the faces, respectively, with the cubic puzzle located in the overall cubic shape, each of the plurality of puzzle pieces includes at least one interior surface having a color selected to provide an identification of an indicia appearing on the at least one tile resulting in the cubic puzzle including a plurality of tiles and a plurality of colored interior surfaces each associated with a respective one of the plurality of tiles; and an electronic system located in the core element, the electronic system including:

a plurality of light sources each associated with one of the plurality of colored interior surfaces, respectively, that is illuminated by the respective one of the plurality of light sources, the plurality of light sources configured to illuminate the plurality of tiles;

at least one color sensor configured to sense the color of each the colored interior surfaces when illuminated by the respective one of the plurality of light sources associated with the selected one of the colored interior surfaces, the at least one color sensor located in the central hollow region; and a processing system coupled to the plurality of light sources and the at least one color sensor and configured to receive information from the at least one color sensor concerning the sensed color, the processing system determining a location and an orientation around the core element of each of the plurality of puzzle pieces based at least in part on the information, wherein the shell is configured to allow light reflected off the plurality of colored interior surfaces to travel through the shell into the hollow central region, wherein the location and orientation are determined from a single static position with the cubic puzzle placed in the overall cubic shape in any of the plurality of unsolved states and independent of information concerning a prior state of the cubic puzzle, and wherein the plurality of light sources are configured to illuminate selected ones of the plurality of tiles to communicate a visual instruction for solving the cubic puzzle from a current state of the puzzle.

17. The cubic puzzle of claim 16, wherein the outer wall includes light transmission features including at least one of a light guide, a plurality of openings defined in the outer wall, a transparent outer wall and a translucent outer wall.

* * * * *